US007599470B2

(12) United States Patent
Kloepfel et al.

(10) Patent No.: US 7,599,470 B2
(45) Date of Patent: Oct. 6, 2009

(54) ARRANGEMENT FOR GENERATING EXTREME ULTRAVIOLET RADIATION FROM A PLASMA GENERATED BY AN ENERGY BEAM WITH HIGH CONVERSION EFFICIENCY AND MINIMUM CONTAMINATION

(75) Inventors: Diethard Kloepfel, Kleinhelmsdorf (DE); Kai Gaebel, Jena (DE)

(73) Assignee: Xtreme technologies GmbH, Jena (DE)

( * ) Notice: Subject to any disclaimer, the term of this patent is extended or adjusted under 35 U.S.C. 154(b) by 380 days.

(21) Appl. No.: 11/733,845

(22) Filed: Apr. 11, 2007

(65) Prior Publication Data

US 2008/0067456 A1 Mar. 20, 2008

(30) Foreign Application Priority Data

Apr. 13, 2006 (DE) ..... 10 2006 017 904

(51) Int. Cl.
*H05G 2/00* (2006.01)
*G21G 4/00* (2006.01)

(52) U.S. Cl. ..... 378/119; 250/504 R

(58) Field of Classification Search ..... 250/504 R, 250/423; 378/119

See application file for complete search history.

(56) References Cited

U.S. PATENT DOCUMENTS 6,707,529 B1 * 3/2004 Aoki et al. ..... 355/30
6,831,963 B2 12/2004 Richardson
7,368,742 B2 * 5/2008 Hergenhan et al. ..... 250/504 R
7,405,413 B2 * 7/2008 Hergenhan et al. ..... 250/492.2
7,465,946 B2 * 12/2008 Bowering et al. ..... 250/504 R
7,476,884 B2 * 1/2009 Gaebel et al. ..... 250/504 R
2002/0145711 A1 * 10/2002 Magome et al. ..... 355/30
2004/0105095 A1 * 6/2004 Stobrawa et al. ..... 356/318
2004/0208286 A1 10/2004 Richardson
2004/0262545 A1 * 12/2004 Hartlove et al. ..... 250/504 R
2005/0169429 A1 * 8/2005 Gaebel et al. ..... 378/119

(Continued)

FOREIGN PATENT DOCUMENTS

EP 0 858 249 4/2003

(Continued)

*Primary Examiner*—Nikita Wells
*Assistant Examiner*—Johnnie L Smith
(74) *Attorney, Agent, or Firm*—Reed Smith LLP

(57) ABSTRACT

The invention is directed to an arrangement for generating extreme ultraviolet radiation from a plasma generated by an energy beam with high conversion efficiency, particularly for application in radiation sources for EUV lithography. It is the object of the invention to find a novel possibility for generating EUV radiation by means of a plasma induced by an energy beam that permits a more efficient conversion of the energy radiation into EUV radiation in the wavelength region of 13.5 nm and ensures a long lifetime of the optical components and the injection device. According to the invention, this object is met by using a mixture of particles with a carrier gas and the target feed device has a gas liquefaction chamber, wherein the target material is supplied to the injection unit as a mixture of solid particles in liquefied carrier gas, and a droplet generator is provided for generating a defined droplet size and series of droplets, wherein means which are controllable in a frequency-dependent manner and which are triggered by the pulse frequency of the energy beam are connected to the injection unit for the series of droplets.

22 Claims, 6 Drawing Sheets

U.S. PATENT DOCUMENTS

| | | | | |
|---|---|---|---|---|
| 2006/0017026 | A1* | 1/2006 | Hergenhan et al. | 250/504 R |
| 2006/0192157 | A1* | 8/2006 | Gaebel et al. | 250/504 R |
| 2006/0291627 | A1* | 12/2006 | Richardson | 378/119 |
| 2007/0158594 | A1* | 7/2007 | Shirai et al. | 250/504 R |
| 2008/0173641 | A1* | 7/2008 | Hadidi et al. | 219/690 |

FOREIGN PATENT DOCUMENTS

| | | |
|---|---|---|
| WO | 02/46839 | 6/2002 |
| WO | 2004/056158 | 7/2004 |
| WO | 2004/084592 | 9/2004 |

* cited by examiner

ARRANGEMENT FOR GENERATING EXTREME ULTRAVIOLET RADIATION FROM A PLASMA GENERATED BY AN ENERGY BEAM WITH HIGH CONVERSION EFFICIENCY AND MINIMUM CONTAMINATION

CROSS-REFERENCE TO RELATED APPLICATION

This application claims priority of German Application No. 10 2006 017 904.8, filed Apr. 13, 2006, the complete disclosure of which is hereby incorporated by reference.

BACKGROUND OF THE INVENTION a) Field of the Invention

The invention is directed to an arrangement for generating extreme ultraviolet radiation from a plasma generated by an energy beam with high conversion efficiency in which a pulsed energy beam is directed in a plasma generation chamber to a location where it interacts with a target, a target feed device contains a mixing chamber for generating a mixture of particles of an emission-efficient target material with at least one carrier gas and an injection unit for dispensing individually defined target volumes into the plasma generation chamber in a metered manner in order to supply only as much emission-efficient target material to the interaction location as can be converted into radiation by an energy pulse. The invention is applied in particular in radiation sources for EUV lithography for the fabrication of semiconductor chips.

b) Description of the Related Art

Known "clean fuels" (target materials such as xenon) are not sufficiently efficient for the generation of EUV radiation based on a plasma which is excited by a pulsed energy beam for emitting in the EUV spectral band around 13.5 nm because their conversion efficiency (ratio of the emitted energy in the desired EUV spectral band to the (laser) excitation energy) is only about 1%. By "clean fuel" is meant that it does not produce a "coating" of components of the radiation source, i.e., it does not generate precipitation (contamination) on surfaces (particularly optical surfaces). Metallic target materials (e.g., elements of groups IV to VII of the 5th period of the periodic table of elements) are substantially more efficient for generating EUV at 13.5 nm (e.g., tin has a conversion factor of approximately 3%), but produce a "coating", i.e., in exciting plasma they generate debris which results especially in precipitation but also leads to ablation of components of the radiation source, especially optical components. Further, ablation processes (removal of material from optical surfaces) which are caused by the high kinetic energy of unconsumed target particles not converted into luminous plasma are appreciably reduced for "clean fuels" (e.g., xenon) compared to metallic target materials.

Pure tin (Sn) delivers a broad-band spectrum around 13.5 nm±2% (desired EUV spectral band for semiconductor lithography, so-called EUV in-band radiation) but also has significant proportions outside the desired EUV spectral band for semiconductor lithography (EUV out-of-band radiation). These out-of-band radiation components are undesirable because they contribute to unnecessary heating of the optics and other source components.

In order to make use of metal-containing targets, it was known in the prior art to use metallic solutions at room temperature as target droplets for laser-generated punctiform plasma. In U.S. Pat. No. 6,831,963 B2, copper compounds and zinc compounds in particular such as chloride solutions, bromide solutions, sulfate solutions, nitrate solutions and organometallic solutions are described as metallic solutions which can be applied in the vicinity of optical components without damage to the latter because hardly any debris is produced. However, substantially only radiation in the range from 11.7 nm to 13 nm is generated, which must be classified as out-of-band radiation components within the meaning of the above-stated requirements of EUV lithography. The same situation is also described for tin compounds, particularly tin chloride, in US 2004/0208286 A1.

As is disclosed in WO 2002/046839 A, an injection of droplets in liquids (e.g., tin as compound or nanoparticle) makes it possible to limit the amount of convertible target material. However, it is disadvantageous that all of the carrier liquids or solvents known for this purpose contain component parts which are damaging to optics (carbon coating, oxygen oxidation, etc.).

WO 2004/056158 A2 describes a device for generating x-ray radiation and EUV radiation in which a mist with an atomic density of $>10^8$ atoms/cm$^3$ is generated for increasing the target density of the smallest possible droplets (on the order of the laser wavelength). The improved target density is generated by the absorption of the target liquid in a nonreactive gas in that an electro-magnetically switchable valve is connected to an ultrasonic nozzle via an expansion duct which is outfitted with heating means for increasing temperature in order to generate a supersaturated vapor and supply it by bursts through the target nozzle for generating plasma. The disadvantage here consists in the elaborate metering procedure and in that the target density drops off quickly after exiting the target nozzle.

Gaseous injections of nanoparticles into a carrier gas, as is described in EP 0 858 249 B1 and WO 2004/084592 A2, are generally not sufficiently concentrated because the particle-containing "gas cloud" expands rather quickly so that the density is too low for an efficient excitation, e.g., by means of a laser, even at a short distance from the injection site (on the order of 1 cm). Therefore, the excitation must be carried out in the vicinity of the injection opening, and limiting the particle quantity to the amount needed for complete energy conversion cannot be accomplished in a simple manner.

WO 2004/084592 A2 discloses a possibility for metering solid target material. A chamber system is provided in which a mixing of solid or liquid target clusters in a gas is carried out in a first chamber. As a result, a "focused mass flow" is generated in a second chamber and arrives in the third chamber for plasma generation through a periodically opening shutter device as a pulsed mass flow in order to provide the necessary amount of convertible target material for each laser pulse and accordingly to reduce the proportion of unconverted target material in the plasma chamber. The target material that is blocked in the second chamber by the shutter device is sucked out and can be reused.

OBJECT AND SUMMARY OF THE INVENTION

It is the primary object of the invention to find a novel possibility for generating EUV radiation by means of a plasma induced by an energy beam that pen-nits a more efficient conversion of the energy radiation into EUV radiation in the wavelength region of 13.5 nm by using metallic target material without the optical components arranged downstream being damaged by debris that is generated as a result of excess target material. Further, the target material can be supplied in such a way that radiation is generated at a great distance from the injection device so as to ensure a long lifetime of the injection device.

Another object of the invention is to find a form of injection for metallic target material which (a) is suitable for efficient absorption of laser radiation of about 1 μm, (b) contributes to the spectral narrowing of the emission band at 13.5 nm, and (c) does not contain any components apart from the metallic target components that damage the source components essential to operation.

In an arrangement for generating extreme ultraviolet radiation from a plasma generated by an energy beam with high conversion efficiency in which a pulsed energy beam is directed in a plasma generation chamber to a location where it interacts with a target, containing a target feed device, a mixing chamber for generating a mixture of particles of an emission-efficient target material with at least one carrier gas, and an injection unit for dispensing individually defined target volumes into the plasma generation chamber in a metered manner in order to supply only as much emission-efficient target material to the interaction location as can be converted into radiation by an energy pulse, the above-stated object is met in that the target feed device has a gas liquefaction chamber, wherein the target material is supplied to the injection unit as a mixture of solid metal particles in liquefied carrier gas, and in that the injection unit has a droplet generator with a nozzle chamber and a target nozzle for generating a defined droplet size and series of droplets, wherein means which are controllable in a frequency-dependent manner and which are triggered by the pulse frequency of the energy beam are connected to the injection unit for generating a time-controlled series of droplets.

The liquefaction chamber is advantageously arranged downstream of the mixing chamber so that the solid particles are supplied to the liquefaction chamber so as to be mixed with the carrier gas, and the liquefaction chamber is designed for the liquefaction of the particle-gas mixture.

In another advisable variant, the liquefaction chamber is arranged upstream of the mixing chamber so that the liquefaction chamber is designed for the liquefaction of the pure carrier gas, and the mixing chamber is designed for mixing the solid particles with the liquefied carrier gas.

The solid emission-efficient particles advantageously comprise tin, a tin compound, lithium, or a lithium compound. The solid particles preferably have a size of less than 10 μm, preferably in the nanometer range and, without limiting generality, are referred to hereinafter as nanoparticles.

Inert gases such as nitrogen or noble gases are advantageously used as carrier gas. Argon is very well-suited for this purpose. In addition, light noble gases (e.g., helium, neon) are advisably mixed in with a carrier gas of the type mentioned above as main component in order to limit the spectral band width of the EUV emission at 13.5 nm, i.e., in order to suppress out-of-band radiation.

The individual targets (droplets) ejected from the injection unit advantageously have a diameter between 0.01 mm and 0.5 mm.

It has proven particularly advantageous for reducing the contamination caused by excess target material when means for removing individual targets are arranged downstream of the target nozzle of the injection unit so that the frequency of the individual targets arriving in the interaction location exactly corresponds to the pulse frequency of the energy beam.

In an advantageous first variant, electric or magnetic deflecting means are arranged downstream of the target nozzle of the injection unit for selective lateral deflection of unnecessary individual targets from the series of droplets dispensed by the target nozzle.

In a second construction for eliminating individual targets, a mechanical closure device (e.g., a mechanical shutter, chopper wheel) is provided after the target nozzle of the injection unit for defined elimination or passage of individual targets from the series of droplets dispensed by the target nozzle.

In a third variant, the injection unit has a target generator with a pressure modulator at the nozzle chamber in order to increase the chamber pressure temporarily for ejecting an individual droplet when needed and has a nozzle antechamber which is arranged downstream of the target nozzle and in which a pressure is maintained that is higher than that of the plasma generation chamber and adapted to the gas pressure of the gas feed to the mixing chamber. Adapting the pressure in the nozzle antechamber surrounding the target nozzle prevents unwanted dripping of target material from the target nozzle as long as no pressure pulse is generated by the pressure modulator. For a suitable pressure adaptation in the nozzle antechamber, the pressure of the gas feed to the mixing chamber is preferably adjusted so as to be slightly higher (on the order of 0.5 to 1 bar higher) than that in the nozzle antechamber.

For producing the liquid particle-gas mixture, a sufficient quantity of particles can also advisably be provided in a reservoir and supplied to a plurality of mixing chambers which are arranged in parallel and connected to the target generator so as to be switchable in series for continuous injection into the plasma generation chamber.

In another advantageous variant, the particles are provided so as to be mixed with the carrier gas in a mixing chamber and a line connection point with a feed line from another carrier gas feed is arranged downstream of the mixing chamber, and at least one of the feed lines to the connection point has a throughflow regulator which is controlled by a measuring device which is arranged downstream of the connection point and which determines the proportion of particles in the gas flow in order to adjust a desired mixture ratio of mixed carrier gas and pure carrier gas. The measuring device for controlling the mixture ratio is preferably an optical scatter light measuring unit.

The pulsed energy beam needed for plasma excitation can comprise at least one laser beam, an electron beam, or an ion beam.

The fundamental idea of the invention is based on the consideration that the conversion of radiated excitation energy into the desired radiation band of 13.5 nm by the excitation of metallic target materials, particularly tin, with a pulsed energy beam is very efficient (three times the conversion efficiency of xenon which is conventionally used). However, metals can be used in a radiation source for EUV lithography only by ensuring extensive absence of contamination which, as is well known, can be achieved by limiting the emitting target material to the amount needed for generating radiation.

The invention solves this problem through the combination of generating a mixture of solid metal particles (nanoparticles with diameters <10 μm) with an inert carrier gas, gas liquefaction, and a metered injection of droplets into the plasma generation chamber.

Supplying the liquid mixture of solid metal particles and carrier gas to the plasma generation chamber by means of an injection device in the form of a droplet generator makes possible (compared to gas puffs) a substantially higher target density and an appreciably greater distance between the location of interaction of the target with the energy beam and the injection location so that radiation yields (conversion efficiency) and contamination (damage to the injection nozzle by debris) are considerably reduced.

When noble gases or nitrogen which themselves do not contain optics-damaging components are used as carrier medium, the liquid target material generated in this way does not lead to further contamination. Sn nanoparticles are preferably used as emitters and, by mixing in a light carrier gas (helium and/or neon) with the main carrier gas, unwanted spectral bands outside the EUV band for semiconductor lithography are extensively suppressed.

Liquefied noble gas or liquid nitrogen can also be used directly for the particle mixture.

The inventive solution makes it possible to generate EUV radiation by means of a plasma induced by an energy beam, which permits a more efficient conversion of the energy radiation into EUV radiation in the wavelength region of 13.5 nm without optical components arranged downstream being further damaged by excess target material. Further, the great distance that can be achieved between the plasma and the injection device ensures a longer life of the injection device and a more stable generation of radiation.

The invention will be described more fully in the following with reference to embodiment examples.

DESCRIPTION OF THE PREFERRED EMBODIMENTS

Figure 1:
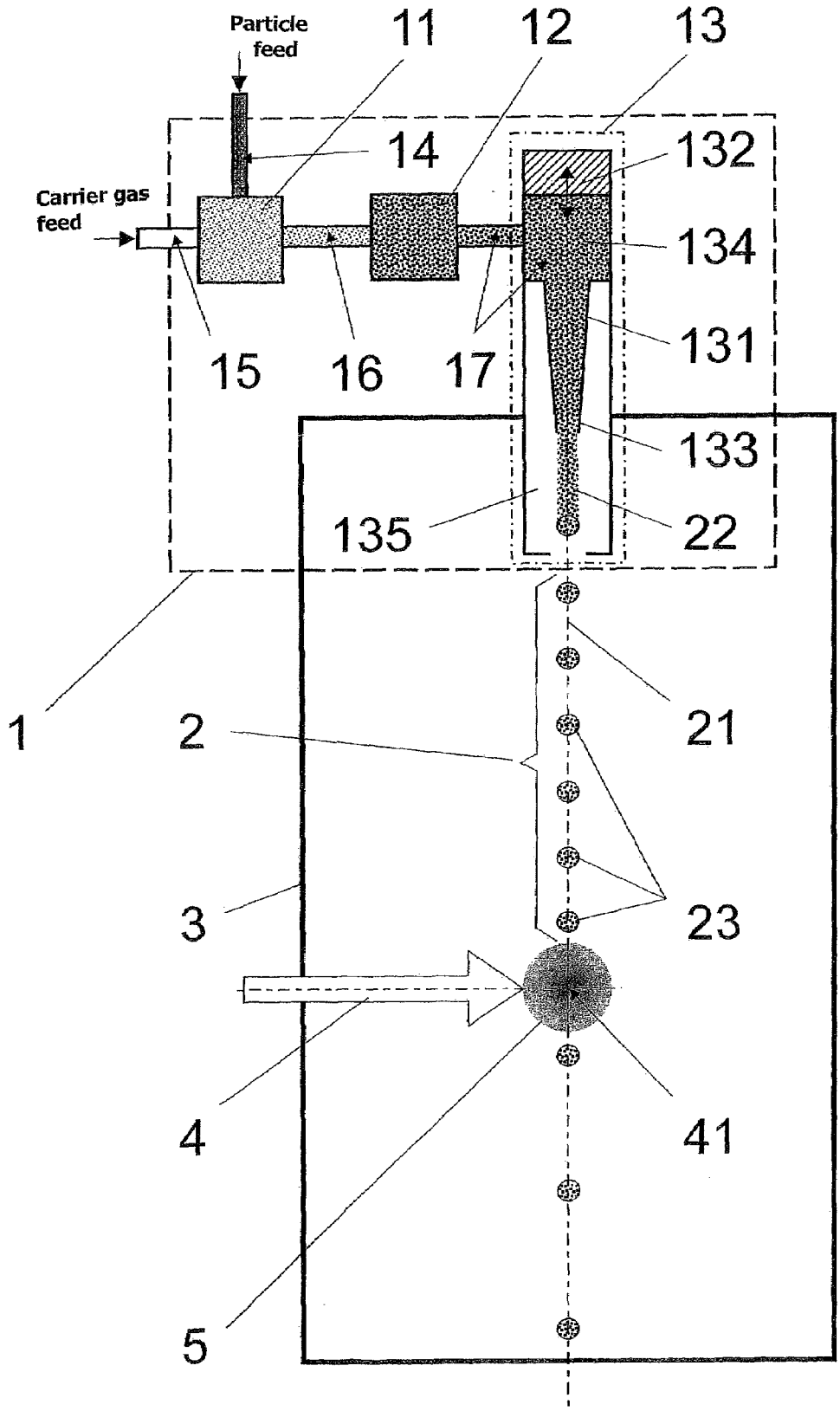
FIG. 1 is a schematic view of an EUV radiation source based on an energy beam in which a mixture of metal particles which is liquefied in a carrier gas is supplied to an injection device, wherein a droplet generator generates a series of droplets which is synchronized with the pulses of the energy beam.

The EUV radiation source has a target feed device 1 which, as is shown schematically in FIG. 1, basically contains a mixing chamber 11, a liquefaction chamber 12 and an injection unit 13. The injection unit 13 has a droplet generator 131, a pressure modulator 132, a target nozzle 133, and a nozzle chamber 134.

Solid particles 14 comprising metals or metal compounds, e.g., tin or lithium (or preferably also their oxides, SnO, $SnO_2$, LiO, $LiO_2$) which emit efficiently in the EUV spectral region (around 13.5 nm) and a clean (i.e., free from emitting particles) carrier gas 15, e.g., noble gases or nitrogen, are combined and mixed in the mixing chamber 11. The resulting particle-containing mixture 16 is fed to the liquefaction chamber 12, wherein liquefaction is carried out at low temperatures ($T<173$ K) and pressures >1 bar. Sn particles (individual particles of at most 10 μm in size) are preferably mixed in to achieve a high efficiency of EUV generation (≈3%). However, mixtures of other elements (e.g., lithium) or compounds (preferably tin compounds or lithium compounds) are also possible.

As is shown schematically in FIG. 1, the mixture of the particles 14 with the carrier gas 15 in a gas phase is carried out in that the particles 14 and the carrier gas 15 are combined in a mixing chamber 11. A number of methods for isolating particles from an existing bulk mass and introducing them into a gas flow in a metered manner are known from particle technology. One possible method is to pull the particles individually out of the bulk mass by means of a special rotating brush and transfer them to a carrier gas flowing past the brush. But the particles 14 can also be present in sufficient quantity in a mixing chamber 11 and, for continuous operation of the EUV source, switching is carried out between a plurality of mixing chambers 11 which are connected in parallel. It is also possible to mix the solid particles 14 into an already existing liquid gas 17 as will be described more fully in the example referring to FIG. 5.

The particle-containing liquid gas 17 is supplied to the injection unit 13 and introduced into the nozzle chamber 134. A stable continuous series 2 of droplets is dispensed along a target axis 21 in the plasma generation chamber 3 by means of a pressure modulator 132 (e.g., piezo-actuator) via the target nozzle 133 in tune with the drop breakup frequency of the liquid gas 17. An energy beam 4 is directed to the target axis 21 at the desired interaction location 41, and the successive pulses of this energy beam 4 respectively excite an individual target 23 (droplet) to form EUV-emitting plasma 5 when this individual target 23 passes the interaction location 41.

The target feed device 1 is incorporated together with the housing of the injection unit 13 in the plasma generation chamber 3. The housing of the injection unit 13 forms a nozzle antechamber 135 around the target nozzle 133 in order to adjust a higher pressure relative to the evacuated plasma generation chamber 3 so that the exit of liquid gas and the droplet formation are stabilized.

The target feed device 1 can also be introduced into the plasma generation chamber 3 at other positions, e.g., at the feed line between the liquefaction chamber 12 and the injection unit 13 or between the mixing chamber 11 and the liquefaction chamber 12.

According to FIG. 1, without limiting generality, a series 2 of droplets of the individual target 23 is generated in tune with the natural drop breakup frequency in that a closed target jet 22 is initially generated which passes into a stable, continuous series of individual targets (droplets) 23 shortly after exiting the target nozzle 133. In general, as is shown schematically in FIG. 1, not every individual target 23 can be struck by a pulse of the energy beam 4. However, droplets 23 which fly past the interaction location without being used can be sucked out at the end of the target axis 21 virtually without damage in a sink coupled with a vacuum pump (not shown).

The injection of the particle-containing liquid gas 17 is carried out in such a way that droplets 23 are formed in the desired size, generally in the form of solid globules, when they reach the interaction location 41 because the liquid gas 17 expands adiabatically and freezes when injected into the vacuum of the plasma generation chamber 2, i.e., after exiting the nozzle antechamber 135 (at higher pressure).

The size of the droplets 23 is defined by the amount of mixture that is optimally excited to form a radiating plasma 5 at a given energy of an excitation pulse of the energy beam 4. The proportion of solid particles 14 in the liquid gas 17 is adjusted in such a way that the efficiency of the EUV generation and the width of the spectrum are optimized. In this way, a limiting of the amount of the Sn particles 14 assumed herein is achieved, i.e., the amount of Sn in the plasma generation chamber 3 is limited to the amount needed for generating radiation so that no excess metallic target material which, as debris, could damage the components of the radiation source as a result of insufficient excitation, remains in the plasma generation chamber 3.

The carrier gas 15 ($N_2$ or a noble gas) can at most be potentially damaging to the optics due to the kinetic energy of its particles. A suppression of sputter processes of this kind is easily possible and is known from xenon-based EUV sources, e.g., by means of introducing a blocking gas (e.g., argon cross-flow) between the plasma 5 and the collector optics. In any case, the carrier gas 15 itself does not contain any component parts that are damaging to optics such as carbon (C) or oxygen ($O_2$).

Because of the injection of the particle-containing mixture 16 in liquid form, a very great distance can be achieved between the generation of radiation (plasma 5) and all of the important components of the system such as the target nozzle 133, collector optics for bundling the generated EUV radiation (not shown), etc. The large distance results in a longer life of these components. In particular, the target nozzle 133 is also substantially less damaged (eroded) by heat radiation and particle radiation from the plasma 5 so that a stable target supply in the interaction location 41 can be achieved over a longer operating period.

Because of the coating property of metallic "fuels" (solid targets), their amount must be limited to the amount necessary for generating radiation. When using tin (Sn), which has strong spectral lines at 13.5 nm, about $5 \cdot 10^{14}$ Sn ions (this corresponds to an Sn volume of about 30 μm diameter) are required for an EUV source size of 0.5 mm diameter with an excitation energy of about 1 J per individual excitation. The source size is derived from the etendue requirement of EUV lithography. The small Sn volume can reasonably be adapted in size to the required source size of the emission prior to excitation by expansion with a pre-pulse of the energy beam 4. The necessary energy is on the order of 10 mJ and is carried out approximately 100 ns before introducing the high-energy pulse.

At a repetition frequency of about 10 kHz, a source with these parameters behind collector optics would reach an EUV in-band output (13.5 nm±2%) of about 100 W. The Sn consumption per day in this case is about 85 g when the quantity of Sn is limited to the amount needed for generating radiation.

The ion density (and electron density) is derived solely from the optimized EUV emission for a homogeneous volume. The electron density is too low for efficient absorption of laser radiation with a wavelength of 1 μm. Therefore, the carrier gas 15 functions additionally as an electron donor to achieve a laser absorption of almost 100%. This is ensured for nitrogen ($N_2$) and argon (Ar) in a stoichiometric proportion of the carrier gas from about 2/3. The stoichiometric proportion is the ratio of the quantity of atoms or molecules of target material (bound in particles) and carrier gas in relation to a volume element.

In addition, by mixing in lighter carrier gases (He, Ne) the spectral bandwidth of the radiation emission of tin at 13.5 nm is reduced, whereas with pure tin it is appreciably greater than the required ±2% (J. Opt. Soc. Am. B 17 (2000) 1616, Choi et al.). Further, the proportion of radiation outside the desired EUV spectrum is likewise appreciably reduced.

A true limiting of the amount of "fuel" (solid particles 14) to the amount needed for generating radiation is only achieved when the target volumes are supplied at a frequency that exactly matches the frequency at which the energy pulses are introduced (on the order of 10 kHz), i.e., exactly one target volume is supplied to the interaction location 41 for each individual generation of radiation. In the following three examples, compared to a variant shown in FIG. 1, to generate a particle-containing series 2 of droplets at high frequency (typically 100 kHz), wherein the natural drop breakup frequency is stabilized by a pressure modulator 132, individual volumes are removed (by various steps) from the series 2 of droplets which is generated at too great a density, so that as a result the frequency of the volumes in the interaction location 41 (plasma 5) matches the frequency of the energy pulses.

Figure 2:
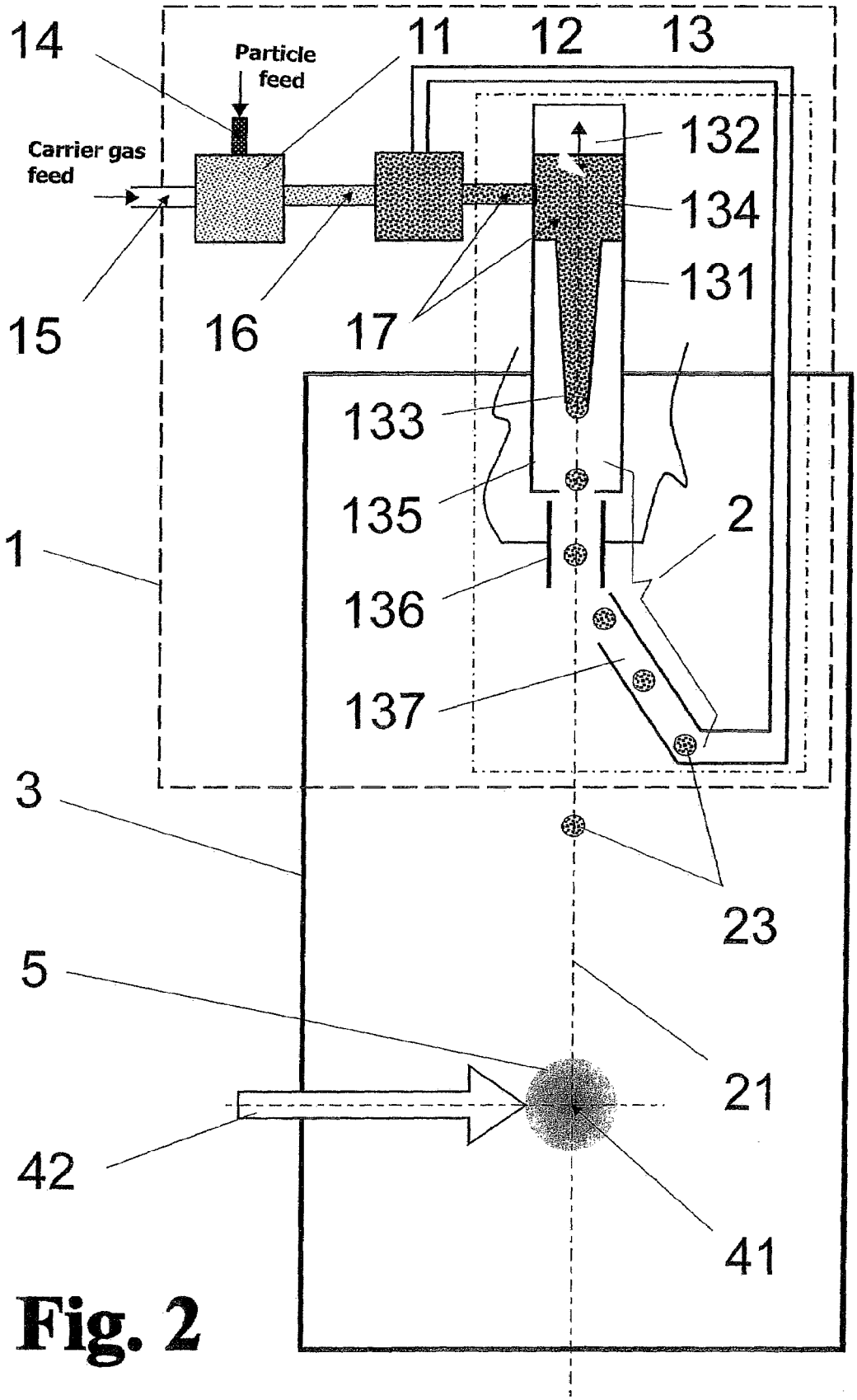
FIG. 2 shows a construction of the EUV source according to FIG. 1 based on a laser-produced plasma (LPP) in which an electric deflecting device and a pump device are arranged downstream of the injector nozzle in order to "thin out" the flow of droplets and adapt the frequency of the droplets in the plasma generation area exactly to the pulse repetition frequency of the laser.

FIG. 2 shows an EUV source constructed in the above manner in which it is assumed without limiting generality that the energy beam 4 is a laser beam 42.

The target feed device 1 differs from that shown in FIG. 1 in that an electric deflecting device 136 and a suction device 137 are connected to the injection unit 13 downstream of the output of the nozzle antechamber 135 in order to "thin" the dense series of droplets 23 and adapt the frequency of the droplets 23 in the location 41 of interaction with a laser beam 42 exactly to the pulse repetition frequency of the laser. The excess droplets 23 are removed by the suction device 137 and supplied again to the liquefaction chamber 12. In this way, in contrast to the construction in FIG. 1, excess droplets 23 are prevented from partially evaporating in the immediate vicinity of the plasma 5 or from contributing generally to the increase in the gas load inside the plasma generation chamber 3.

Figure 3:
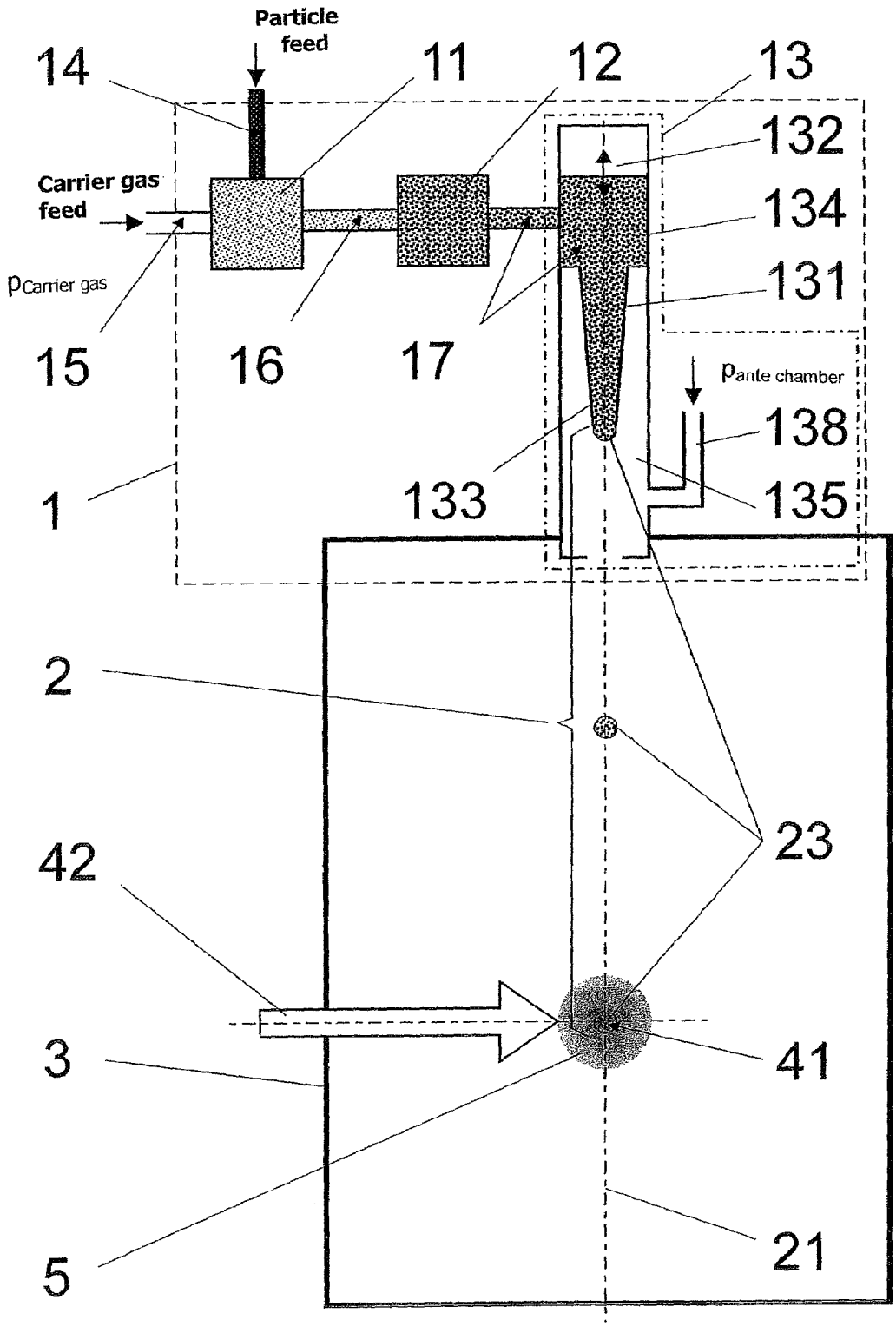
FIG. 3 shows a preferable realization of the EUV source according to the invention in which a nozzle antechamber downstream of the injector nozzle is followed by pressure compensating means which supply a pressure which is increased over that of the plasma generation chamber and which corresponds approximately to the pressure of the carrier gas feed so that the droplets are generated by a pressure modulator of the nozzle chamber exactly to the pulse rate of the laser.

In a second variant (according to FIG. 3), the particle-containing droplets 23 are already generated so as to correspond exactly to the pulse frequency of the laser beam 42. FIG. 3 shows a modified droplet selection in which pressure compensating means 138 which supply a pressure $p_{antechamber}$ approximately corresponding to the gas pressure $p_{carrier\ gas}$ supplied to the mixing chamber 11 are connected directly to the nozzle antechamber 135. Accordingly, the droplets 23 are released through the pressure modulator 132 with exactly the same frequency as the pulse frequency of the laser beam 42 so that the injection device 13 ejects droplets 23 only in such quantity that every droplet 23 is struck by exactly one pulse of the laser beam 42.

This is realized in a reliable manner in that the nozzle antechamber 135 of the injection unit 13 downstream of the target nozzle 133 is connected to pressure compensating means 138 which are adapted to the pressure $p_{carrier\ gas}$ of the gas feed to the mixing chamber 11 so that the liquid target material cannot form any unwanted droplets 23 in the nozzle chamber 134 and enter the plasma generation chamber 3 without a temporary pressure increase of the pressure modulator 132. The pressure modulator 132 which can be, e.g., a piezo-actuator arranged at the nozzle chamber 134 generates pressure pulses at the frequency of the energy pulses, i.e., only individual targets 23 are supplied as needed (corresponding to the triggered pulses of the laser beam 42).

Figure 4:
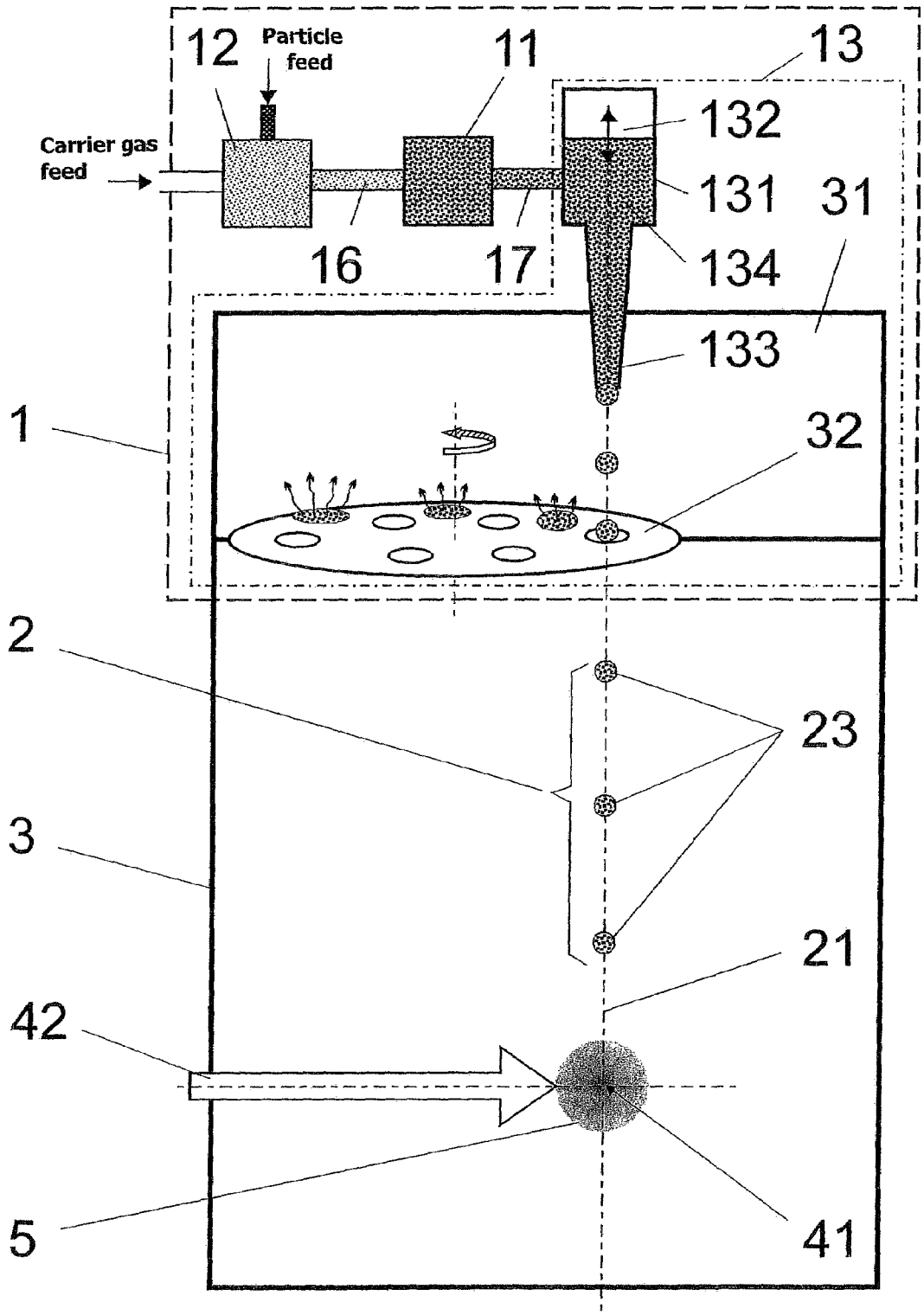
FIG. 4 shows another construction of an LPP radiation source in which a mechanical device (chopper) is arranged after the target nozzle for "thinning" the series of droplets in order to adapt the frequency of the droplets in the interaction location to the pulse rate of the laser.

FIG. 4 shows a droplet selection having the same effect as that in FIG. 3 in which exactly one individual droplet 23 is associated with each pulse of the laser beam 42. In this construction, however, mechanical means in the form of a rotating aperture plate 32 are provided to pass only every nth droplet 23 into the plasma generation chamber 3. At the same time, the aperture plate 32 makes up part of a vessel wall which partitions the plasma generation chamber 3 to form an antechamber 31, and a higher pressure $p_{antechamber}$ is adjusted in the antechamber 31 as in the previous examples in the nozzle antechamber 135. Therefore, a separate nozzle antechamber 135 of the injection unit 13 can be dispensed with in this example.

It is shown schematically in FIG. 4 that every second droplet 23 is intercepted on the aperture plate 32 and sublimed or evaporated thereon and can be sucked out of the antechamber 31 through a separate pump unit (not shown). Under real conditions, only about every tenth droplet 23 is passed for interaction with the laser beam 42.

Figure 5:
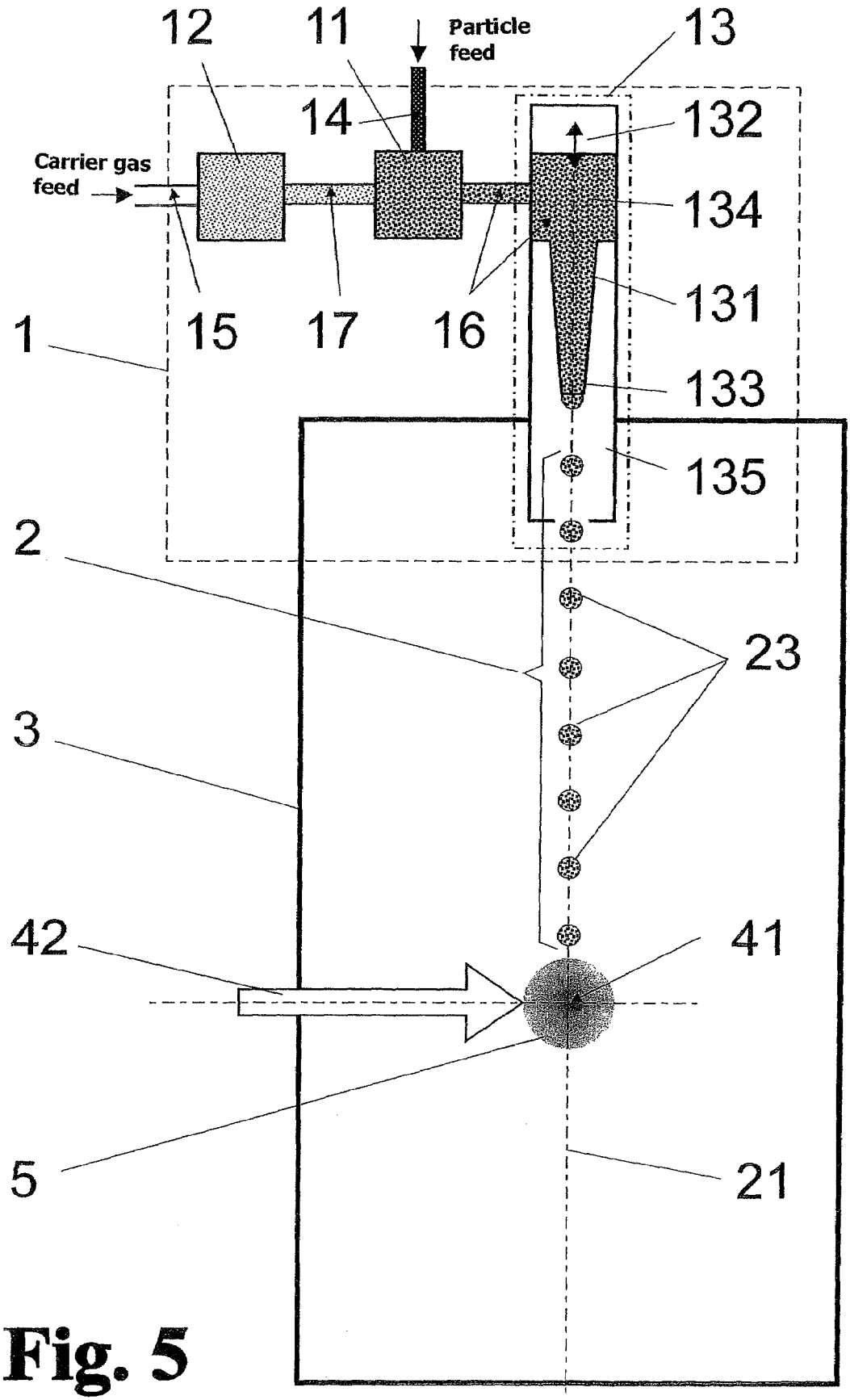
FIG. 5 shows another modification of the EUV source according to the invention in which pure carrier gas which is already liquefied is mixed with the solid particles in the mixing chamber and supplied to the injection device for generating a defined series of droplets.

As was already mentioned above, it is also useful to mix solid particles 14 into carrier gas 15 which has already been liquefied beforehand. An arrangement of this kind is shown in FIG. 5. In this construction, the mixing chamber 11 and the liquefaction chamber 12 are reversed with respect to the preceding examples. Further, the carrier gas is fed into the liquefaction chamber 12, and the liquid gas 17 produced therein is introduced into the mixing chamber 11 so as to be mixed with the solid particles 14. Otherwise, the construction is the same as that shown in FIG. 1, but could also be realized according to the constructions in FIGS. 2 to 4.

Figure 6:
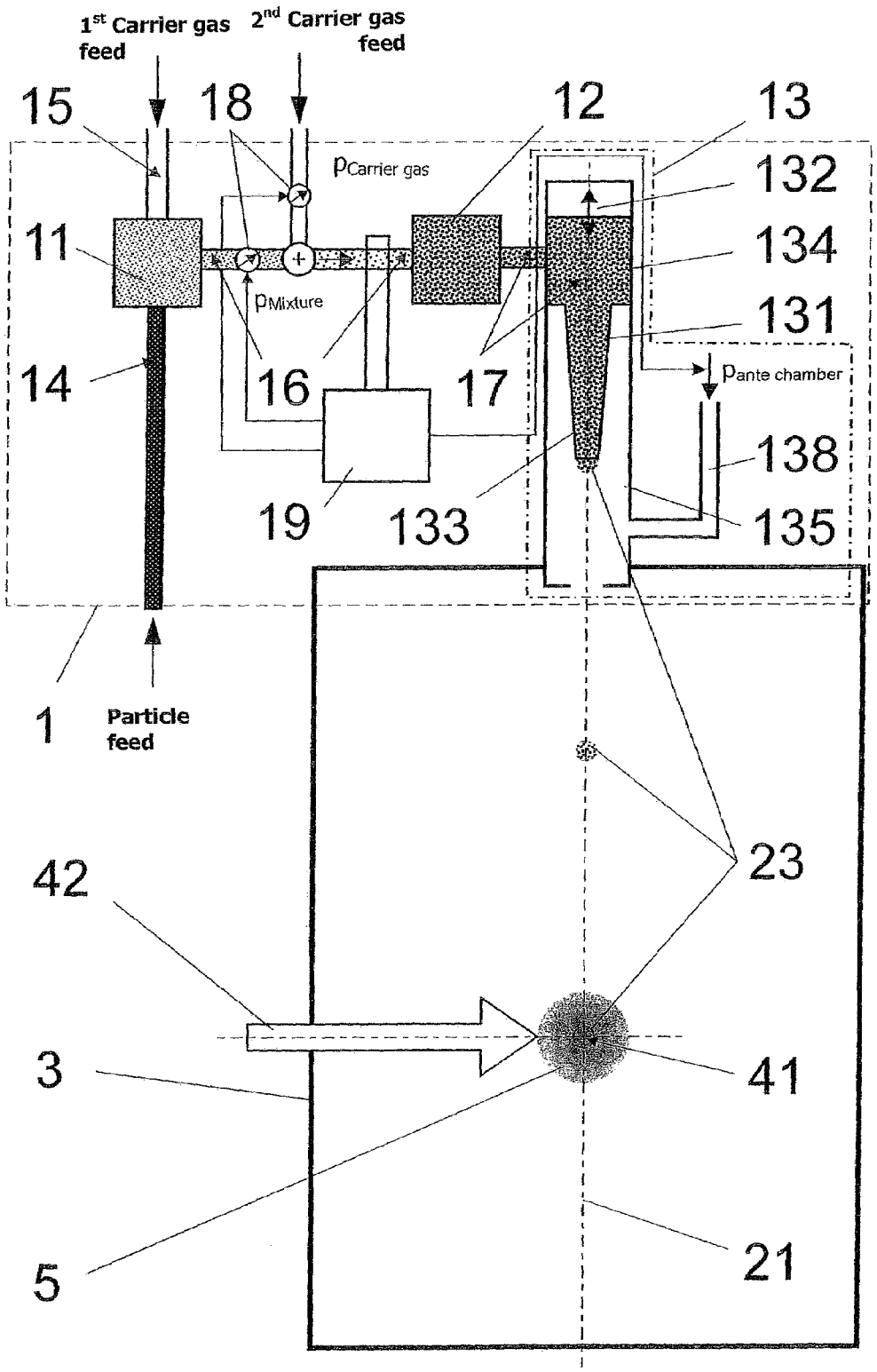
FIG. 6 shows another construction of the EUV source according to the invention in which a line connection point with another feed line of carrier gas is provided downstream of the mixing chamber, and a measuring device which is arranged downstream of the connection point controls throughflow regulators in the feed lines to the connection point in order to regulate the particle density and gas pressure.

A preferred variant of the invention is shown in FIG. 6. In this case, it is assumed that the solid emission-efficient particles 14 are already mixed with the carrier gas 15 in a mixing chamber 11 functioning as a reservoir. In order to isolate the particles 14 from the existing bulk mass (not shown) and introduce them into a gas flow in a metered manner, the particles 14 are removed individually from the bulk mass by a rotating brush and are transferred to a flow of carrier gas 15 which flows past. As the flow of gas proceeds, it must be ensured through a suitable design of the lines conducting the carrier gas that the particles do not become unmixed.

The line proceeding from the mixing chamber 11 in direction of the injection unit 13 is then tied to another carrier gas line in a connection point (+) in such a way that the gas flows can be regulated relative to one another by means of a throughflow regulator 16 prior to the connection point (+).

A measuring device 19 arranged downstream of the connection point (+) serves to determine a regulating variable. The measuring device 19 measures the actual mixture ratio, e.g., by measuring scatter light, and accordingly supplies a correcting variable for the relative adjustment of the supplied amounts of clean carrier gas 15 and particle-containing mixture 16. This additional admixing of carrier gas enables a very accurate adjustment of the proportion of solid particles 14 per volume unit of carrier gas 15 and therefore a highly accurate metering of the effective target quantity (particles 14) per droplet 23 of the liquid gas generated therefrom.

Although FIG. 6 shows both feed lines of the clean carrier gas 15 and particle-containing mixture 16 to the connection point (+) with throughflow regulators 18, it would also be sufficient when one of the feed lines, preferably the carrier gas feed line, is outfitted with a throughflow regulator 18. Further, the measuring device 19 which directly influences the pressure adjustment in front of the liquefaction chamber 12 according to FIG. 6 can also be used for an adapted pressure regulation of the pressure $p_{antechamber}$ in the nozzle antechamber 135. Accordingly, the construction shown in FIG. 4 makes possible a suitably adapted pressure regulation for supplying droplets 23 exclusively when needed (drop on demand), i.e., so as to correspond to the pulse rate of the laser beam 42.

While the foregoing description and drawings represent the present invention, it will be obvious to those skilled in the art that various changes may be made therein without departing from the true spirit and scope of the present invention.

Reference Numbers
1 target feed device
11 mixing chamber
12 liquefaction chamber
13 injection unit
131 droplet generator
132 pressure modulator
133 target nozzle
134 nozzle chamber
135 nozzle antechamber
136 deflecting device
137 suction device
138 pressure compensating means
14 (solid) particles
15 carrier gas
16 particle-containing mixture
17 liquid gas
18 throughflow regulator
19 measuring device
2 series of droplets
21 target axis
22 target jet
23 individual target (droplet)
3 plasma generation chamber
31 antechamber (of the plasma generation chamber)
32 (rotating) aperture plate
4 energy beam
41 interaction location
42 laser beam
5 plasma
p pressure

What is claimed is:

1. An arrangement for generating extreme ultraviolet radiation from a plasma generated by energy beam with high conversion efficiency comprising:

a pulsed energy beam;

a plasma generation chamber, said pulsed energy beam being directed to a location in said chamber where it interacts with a target;

a target feed device containing a mixing chamber for generating a mixture of particles of an emission-efficient target material with at least one carrier gas and containing an injection unit for dispensing individually defined target volumes into the plasma generation chamber in a metered manner in order to supply only as much emission-efficient target material to the interaction location as can be converted into radiation by an energy pulse;

said target feed device having a gas liquefaction chamber;

said target material being supplied to the injection unit as a mixture of solid metal particles in liquefied carrier gas;

said injection unit having a droplet generator with a nozzle chamber and a target nozzle for generating a defined droplet size and series of droplets; and means, which are controllable in a frequency-dependent manner and which are triggered by the pulse frequency of the energy beam, being connected to the injection unit for generating a time-controlled series of droplets.

2. The arrangement according to claim 1, wherein the liquefaction chamber is arranged downstream of the mixing chamber so that the solid particles are supplied to the liquefaction chamber so as to be mixed with the carrier gas, and the liquefaction chamber is designed for liquefying the mixture.

3. The arrangement according to claim 1, wherein the liquefaction chamber is arranged upstream of the mixing chamber so that the liquefaction chamber is designed for liquefying the clean carrier gas, and the mixing chamber is designed for mixing the solid particles with the liquefied carrier gas.

4. The arrangement according to claim 1, wherein the solid emission-efficient particles comprise tin or a tin compound.

5. The arrangement according to claim 1, wherein the solid emission-efficient particles comprise lithium, or a lithium compound.

6. The arrangement according to claim 1, wherein the solid emission-efficient particles have a size of less than 10 μm.

7. The arrangement according to claim 1, wherein the carrier gas is a noble gas, preferably argon.

8. The arrangement according to claim 7, wherein the noble gas is argon.

9. The arrangement according to claim 1, wherein the carrier gas is nitrogen.

10. The arrangement according to claim 1, wherein light noble gases are mixed in with a carrier gas that is selected as the main component in order to limit more narrowly the spectral band width of the EUV emission at 13.5 nm.

11. The arrangement according to claim 1, wherein individual droplets ejected from the injection unit have a diameter between 0.01 mm and 0.5 mm.

12. The arrangement according to claim 1, wherein means for removing individual targets are arranged downstream of the target nozzle of the injection unit so that the frequency of the individual targets arriving in the interaction location exactly corresponds to the pulse frequency of the energy beam.

13. The arrangement according to claim 12, wherein electric deflecting means are arranged downstream of the target nozzle of the injection unit for lateral deflection of unnecessary individual targets from the series of droplets dispensed by the target nozzle.

14. The arrangement according to claim 12, wherein a mechanical closure device is arranged downstream of the target nozzle of the injection unit for defined elimination and passage of individual targets from the series of droplets dispensed by the target nozzle.

15. The arrangement according to claim 12, wherein the target generator of the injection unit has a pressure modulator at the nozzle chamber in order to increase the chamber pressure temporarily for ejecting an individual droplet when needed, and a nozzle antechamber is arranged downstream of the target nozzle, wherein a pressure which is higher than that in the plasma generation chamber and which is adapted to the gas pressure of the gas feed to the mixing chamber is adjusted in the nozzle antechamber to prevent unwanted dripping of target material from the target nozzle as long as no pressure pulse is generated by the pressure modulator.

16. The arrangement according to claim 15, wherein the pressure of the gas feed to the mixing chamber is adjusted so as to be slightly higher than that in the nozzle antechamber in order to adapt the pressure in the nozzle antechamber.

17. The arrangement according to claim 1, wherein a sufficient quantity of particles is provided in a reservoir and supplied to a plurality of mixing chambers which are arranged in parallel and connected to the injection unit so as to be switchable in series for continuous injection into the plasma generation chamber.

18. The arrangement according to claim 1, wherein the particles are provided so as to be mixed with the carrier gas in a mixing chamber and a line connection point with a feed line from another carrier gas feed is arranged downstream of the mixing chamber, wherein at least one of the feed lines to the connection point has a throughflow regulator which is controllable by a measuring device which is arranged downstream of the connection point and which determines the proportion of particles in the gas flow in order to adjust a desired mixture ratio of mixed carrier gas and clean carrier gas.

19. The arrangement according to claim 18, wherein the measuring device for controlling the mixture ratio is an optical scatter light measuring unit.

20. The arrangement according to claim 1, wherein the pulsed energy beam is at least one laser beam.

21. The arrangement according to claim 1, wherein the pulsed energy beam is an electron beam.

22. The arrangement according to claim 1, wherein the pulsed energy beam is an ion beam.

* * * * *